US009868315B2

(12) United States Patent
Oshiro

(10) Patent No.: US 9,868,315 B2
(45) Date of Patent: Jan. 16, 2018

(54) COLOR ERASING APPARATUS AND METHOD OF CONTROLLING TEMPERATURE OF HEAT SOURCE IN COLOR ERASING APPARATUS

(71) Applicants: KABUSHIKI KAISHA TOSHIBA, Tokyo (JP); TOSHIBA TEC KABUSHIKI KAISHA, Tokyo (JP)

(72) Inventor: Toshiaki Oshiro, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/247,250

(22) Filed: Aug. 25, 2016

(65) Prior Publication Data

US 2016/0361940 A1 Dec. 15, 2016

Related U.S. Application Data

(63) Continuation of application No. 14/684,866, filed on Apr. 13, 2015, now Pat. No. 9,446,615, which is a (Continued)

(51) Int. Cl.
*B41M 7/00* (2006.01)
*B41J 29/26* (2006.01)

(Continued)

(52) U.S. Cl.
CPC ..... *B41M 7/0009* (2013.01); *B41J 2/32* (2013.01); *B41J 2/4753* (2013.01); *B41J 29/26* (2013.01);

(Continued)

(58) Field of Classification Search
CPC ..... B41M 7/00; B41M 7/0009; B41M 7/009; B41J 2/32; B41J 29/26; B41J 2202/37
See application file for complete search history.

(56) References Cited

U.S. PATENT DOCUMENTS 7,079,802 B2 7/2006 Katayanagi et al.
2010/0194839 A1 8/2010 Taguchi et al.

(Continued)

FOREIGN PATENT DOCUMENTS

JP H06-230626 8/1994
JP H09-204080 8/1997

(Continued)

*Primary Examiner* — Kristal Feggins
(74) *Attorney, Agent, or Firm* — Patterson & Sheridan, LLP

(57) ABSTRACT

A color erasing apparatus according to an embodiment includes a color erasing unit with a heating unit that heats a paper to erase an image formed on the paper by a heat-erasable coloring material. A sensor outputs a sensor signal indicative of a thickness of the paper. A paper thickness detector determines the thickness of the paper based on the sensor signal. A heating unit controller controls temperature of the heating unit based on the thickness of the paper determined by the paper thickness detector. When the thickness of the paper determined by the paper thickness detector is greater than a predetermined thickness, the temperature is controlled to be a first temperature. When the thickness of the paper determined by the paper thickness detector is less than the predetermined thickness, the temperature is controlled to be a second temperature less than the first temperature.

17 Claims, 8 Drawing Sheets

Related U.S. Application Data continuation of application No. 13/858,867, filed on Apr. 8, 2013, now Pat. No. 9,030,510.

(60) Provisional application No. 61/622,437, filed on Apr. 10, 2012.

(51) Int. Cl.

| | |
|---|---|
| ***B41J 2/475*** | (2006.01) |
| ***B41J 2/32*** | (2006.01) |
| ***B41J 29/393*** | (2006.01) |

(52) U.S. Cl.

CPC ..... *B41J 29/393* (2013.01); *B41M 7/009* (2013.01); *B41J 2002/4756* (2013.01)

(56) References Cited

U.S. PATENT DOCUMENTS

| | | | |
|---|---|---|---|
| 2011/0074901 | A1 | 3/2011 | Tsuchihashi et al. |
| 2013/0002784 | A1 | 1/2013 | Iguchi et al. |

FOREIGN PATENT DOCUMENTS

| | | |
|---|---|---|
| JP | 2002-274733 | 9/2002 |
| JP | 2003-084507 | 3/2003 |
| JP | 2003-107944 | 4/2003 |

COLOR ERASING APPARATUS AND METHOD OF CONTROLLING TEMPERATURE OF HEAT SOURCE IN COLOR ERASING APPARATUS

CROSS-REFERENCE TO RELATED APPLICATIONS

This application is continuation of co-pending U.S. patent application Ser. No. 14/684,866, filed on Apr. 13, 2015, which is a continuation of U.S. patent application Ser. No. 13/858,867, filed on Apr. 8, 2013, now U.S. Pat. No. 9,030,510, issued on May 12, 2015, which is based upon and claims the benefit of priority from U.S. Provisional Patent Application No. 61/622,437, filed on Apr. 10, 2012, the entire contents of each of which are incorporated herein by reference.

FIELD

Embodiments described herein relate generally to color erasing apparatus and a method of controlling the temperature for the heat source of the color erasing apparatus.

BACKGROUND

In recent years, image forming devices such as Multi Function Peripherals (MFP) have been used to generate graphics on sheet-shaped media such as paper (hereinafter collectively referred to as "the paper"). In addition, erasable coloring materials such as ink containing leuco dye have been used to print graphics on the paper in order to erase graphics on the papers for the purpose of recycling. Applying a higher temperature erases the color. An color erasing apparatus, including a platen roller facing a heat source and a conveying path of the paper in the middle, heats the paper by conveying the paper in between the platen roller and the heat source, and erases the erasable coloring material.

However, the conventional color erasing apparatus conducts heating at a certain condition regardless of the thickness of the paper. Therefore, the output power for the heat source for erasing a color is controlled is the same for thicker papers having a higher heat capacity as it is for papers having a lower heat capacity. Consequently, there is a problem of higher power consumption.

DETAILED DESCRIPTION

Figure 1:
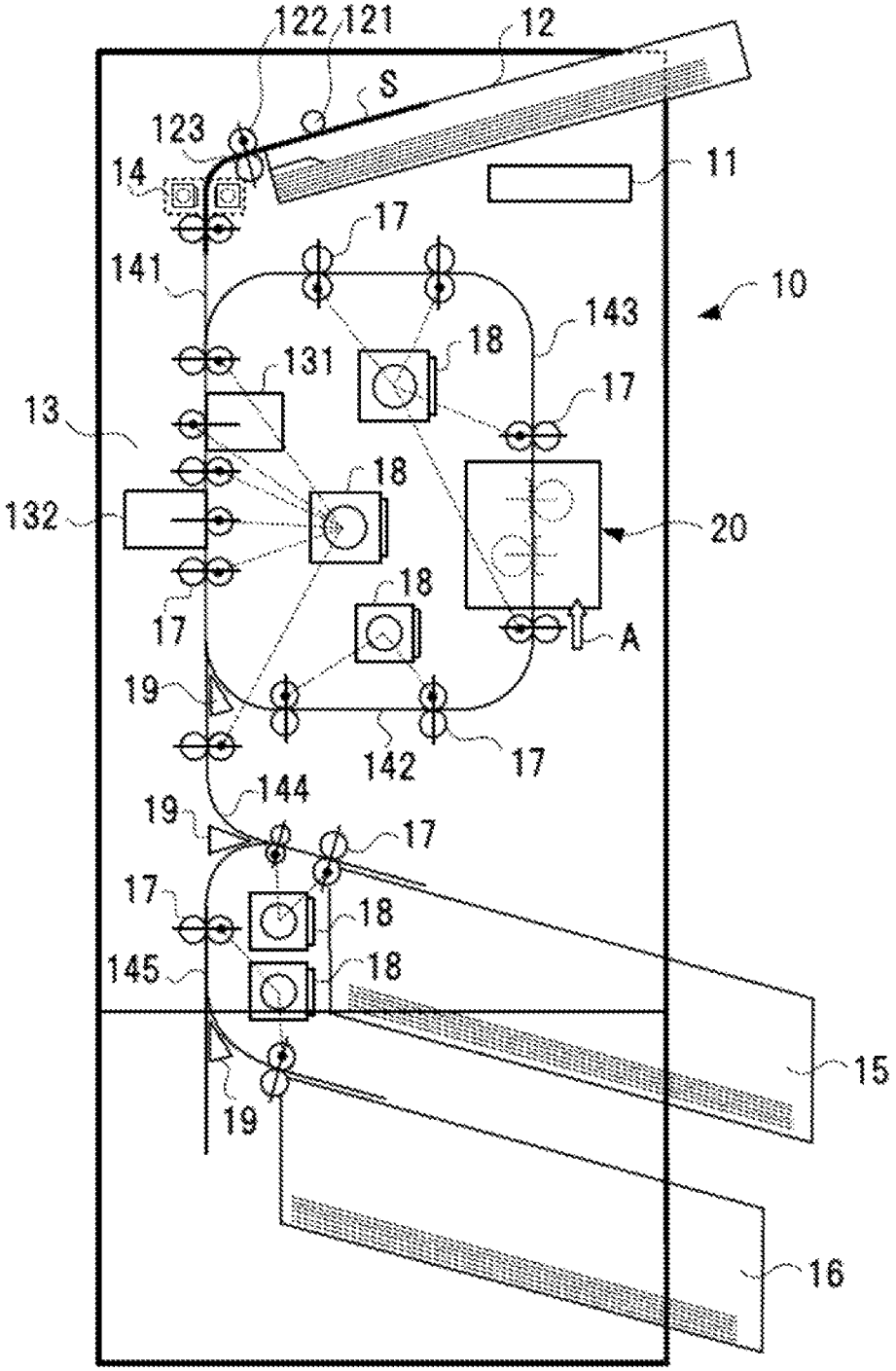
FIG. 1 illustrates an overall configuration of a color erasing apparatus according to one embodiment.

A color erasing apparatus according to an embodiment comprises a paper feeding section configured to supply to a conveying path a paper on which images are formed by a heat-erasable coloring material, a sensor configured to output a sensor signal indicative of a thickness of the paper, and a paper thickness detector configured to determine the thickness of the paper based on the sensor signal. The color erasing apparatus further comprises a color erasing section including a heat source configured to heat the paper; and a heat source temperature controller configured to control the heat source in the color erasing section to a predetermined temperature based on the determined thickness of the paper.

A method for erasing images according to embodiments comprises feeding a paper having images formed by heat-erasable coloring material to a conveying path, providing a sensor signal indicative of a thickness of the paper, and detecting thickness of the paper based on the sensor signal. The method for erasing images further comprises controlling a heat source to a predetermined temperature based on the detected thickness of the paper, and conveying the paper in the conveying path through the heat source at the predetermined temperature to erase the images on the paper.

A color erasing apparatus according to additional embodiments comprises a paper feeding section configured to supply to a conveying path a paper on which images are formed by a heat-erasable coloring material, a sensor configured to output a sensor signal indicative of a thickness of the paper, and a paper thickness detector configured to determine the thickness of the paper based on the sensor signal. The color erasing apparatus further comprises a color erasing section including a heat source configured to heat the paper, and a motor driving controller configured to control a conveying speed of the paper through the color erasing section at a predetermined speed based on the determined thickness of the paper.

Hereafter, an embodiment to conduct the present disclosure will be explained referring to the drawings. Identical references are used for the identical places in each drawing.

FIG. 1 illustrates a pattern diagram of the overall configuration of an color erasing apparatus 10 relates to the embodiment. The color erasing apparatus 10 includes an operating panel 11 including operation buttons and a display, a paper feeding section 12, a scanner 13 as a scanning section, an ultrasonic sensor 14 that detects the conveying status of the paper, and a color erasing section 20 that erases images on the paper. In addition, the color erasing apparatus 10 includes a first conveying path 141, a second conveying path 142, a third conveying path 143, a fourth conveying path 144 and a fifth conveying path 145. The fifth conveying path 145 conveys paper to a first paper discharge tray 15 or a second paper discharge tray 16 (reject box).

Each conveying path 141 to 145 has a plurality of conveying rollers 17 to convey the paper S and a plurality of motors 18 to drive each conveying roller 17. Each of the conveying paths 141 to 145 provides a plurality of gates 19 in order to accurately direct the paper S to the appropriate conveying path 141 to 145.

The first conveying path 141 conveys the paper S from the paper feeding section 12 to the scanner 13. The second converting path 142 conveys the paper S from the scanner 13 to the color erasing section 20 in the direction shown by the arrow A. The third conveying path 143 conveys the paper S from the color erasing section 20 to the scanner 13 again. The fourth conveying path 144 conveys the paper S from the scanner 13 to the first paper discharge tray 15. The fifth conveying path 145 conveys the paper S from the scanner 13 to the second paper discharge tray 16.

The first paper discharge tray 15 retrieves the paper S which is determined to be reusable after erasing images. The second paper discharge tray 16 retrieves the paper S which determined to not be reusable and is discarded for recycling paper.

The color erasing apparatus 10 operates the following steps (1) to (5) in general.

(1) The paper S fed from the paper feeding section 12 by the first conveying path 141 is scanned by the scanner 13. The scanner 13 includes a first scanner 131 and a second scanner 132 to scan both side of the paper. The scanner 13 scans image data of the paper before erasing graphics on the paper. Simultaneously, the scanner 13 scans the printing condition of the paper.

(2) The image data scanned by the scanner 13 is stored. In case tearing or a wrinkle in the paper is detected based on the printing condition scanned by the scanner 13, the paper is guided to the fifth conveying path 145 and sent to the second paper discharge tray 16. The paper without tearing or a wrinkle is conveyed through the second conveying path 142 and sent to the color erasing section 20.

(3) The paper sent to the color erasing section 20 is heated while passing through the color erasing section 20 and images formed on the paper are erased. The color erasing section 20 is heated at relatively high temperature, for example, 180 to 200° C. As the paper passes through the color erasing section, the paper is heated and pressurized, and images formed on the paper with erasable coloring material are erased. A concrete configuration of the color erasing section 20 will be described below.

(4) The paper, after passing through the color erasing section 20, is conveyed to the scanner 13 again by the third conveying path 143. The scanner 13 scans the printing condition again and confirms whether images formed with the erasable coloring material have been acceptably erased.

(5) Reusable papers are conveyed to the first paper discharge tray 15 by the fourth conveying path 144. In some cases, images formed with non-erasable coloring material or handwritten images remain on the paper. Likewise, based on the printing condition scanned by the scanner 13, the paper may be determined to have tearing or a wrinkle. Such non-reusable papers are conveyed to the second paper discharge tray 16 by the fifth conveying path 145.

Figure 2:
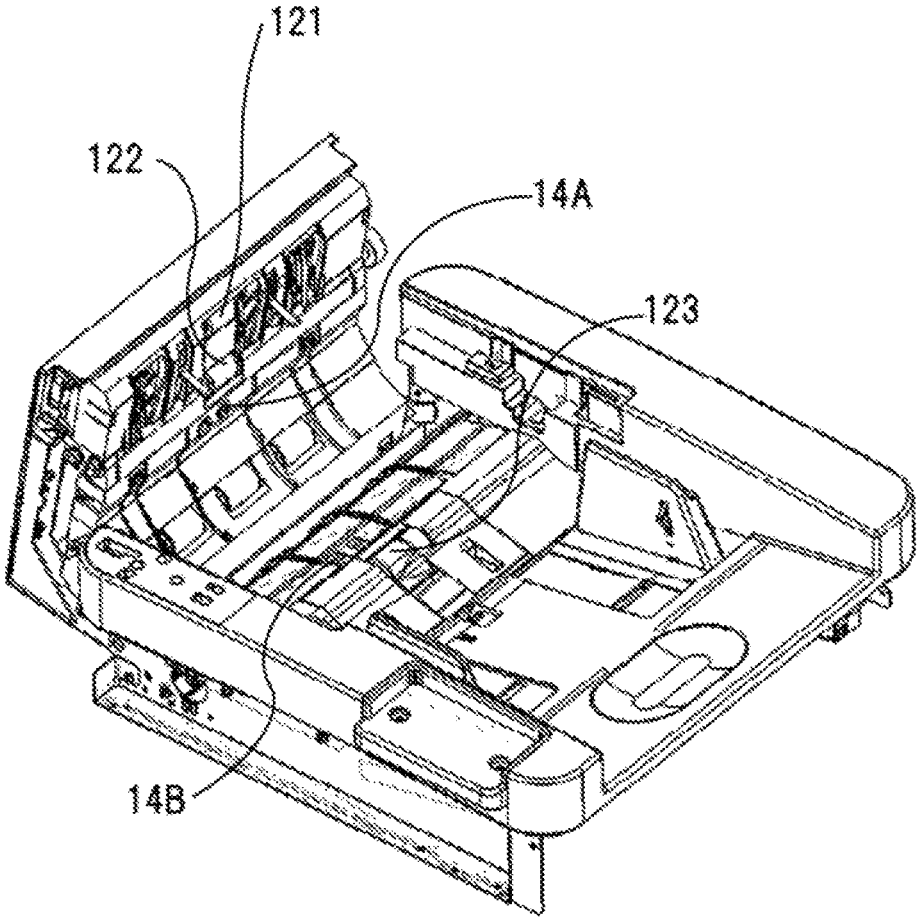
FIG. 2 illustrates an external view of the apparatus shown in FIG. 1 for erasing a color upon opening the top part.
Figure 3:
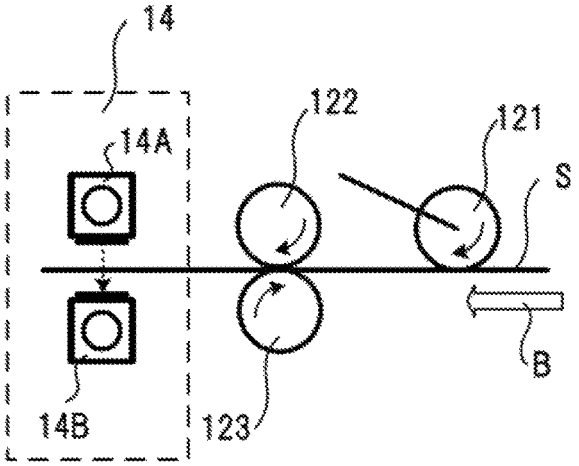
FIG. 3 illustrates an arrangement of certain structures in the vicinity of an ultrasonic sensor shown in FIG. 2.

FIG. 2 illustrates the external view of the color erasing apparatus 10 upon opening the top part. FIG. 3 illustrates an arrangement of certain structure in the vicinity of the ultrasonic sensor 14. As shown in these drawings, the paper S is picked up from the paper feeding tray 120 and proceeds towards a feeding roller 122, upon rotating of a pick-up roller 121 provided in the paper feeding section 12. A separating roller 123 is provided opposite of the feeding roller 122, with the conveying path 141 in the middle. The separating roller 123 rotates in the opposite direction of the feeding roller 122 in order to prevent two or more papers S being conveyed to the conveying path. The ultrasonic sensor 14 is provided downstream (in the paper conveying direction) of the feeding roller 122 and the separating roller 123, as shown by the arrow B in FIG. 3. The ultrasonic sensor 14 has an ultrasonic transmitter 14A and an ultrasonic receiver 14B facing each other, with the conveying path 141 in the middle. The ultrasonic transmitter 14A transmits an ultrasonic signal to the paper S. The ultrasonic receiver 14B outputs voltage signals, according to a portion of the ultrasonic signal that penetrated the paper S, to the controller of the color erasing apparatus 10 described below.

Figure 4:
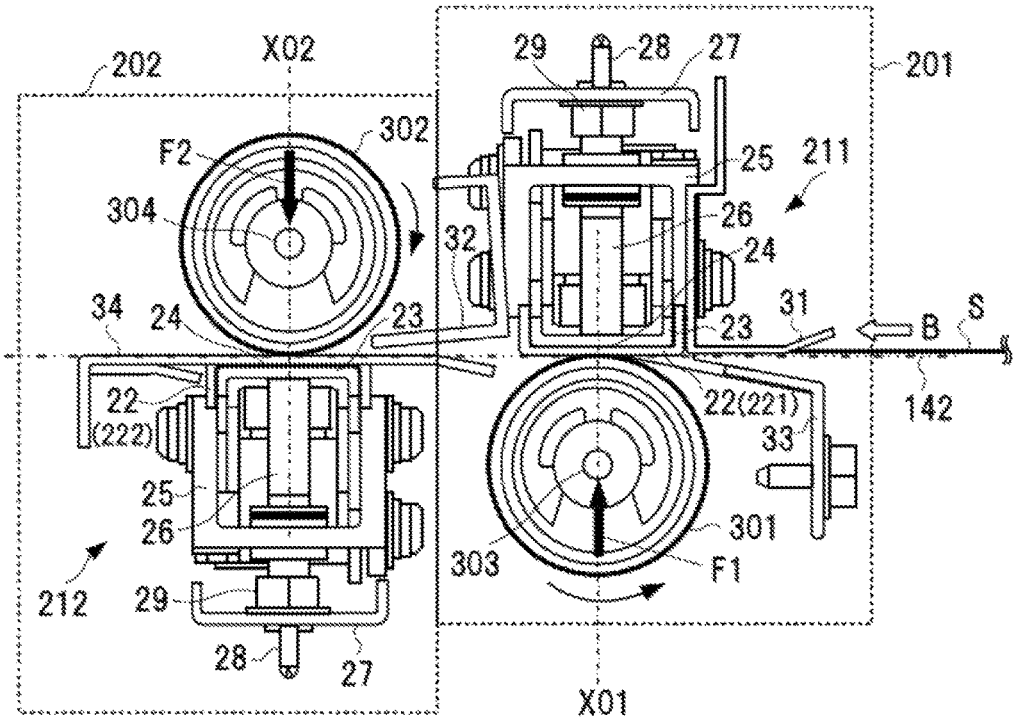
FIG. 4 illustrates a side view of the internal structure of the color erasing apparatus shown in FIG. 1.

Next, an example embodiment of the color erasing section 20 will be described. FIG. 4 illustrates a side view of the internal structure of the color erasing section 20. The color erasing section 20 conveys the paper S that is fed from the paper feeding section 12 and is heated with the heat source at the predefined temperature to erase images on the paper S.

As shown in FIG. 4, the color erasing section 20 includes a first color erasing section 201 and a second erasing section 202. The first color erasing section 201 includes a heating section 211 and a platen roller 301. Similarly, the second erasing section 202 includes a heating section 212 and a platen roller 302. The first color erasing section 201 and the second color erasing section 202 have the same configuration, but are inverse with respect to each other. The platen roller 301 and the platen roller 302 rotate about rotating shafts 303 and 304, respectively. The platen roller 301 and the platen roller 302 have a cylinder shape in the width direction of the paper S.

Hereafter, the heating section 211 of the first color erasing section 201 will be described. The paper S is conveyed, as indicated by the arrow B, onto the second conveying path 142. The direction of the arrow B corresponds to the direction of the arrow A in FIG. 1. The heating section 21 includes a heating plate 22 that is in a U shape in cross-section and has a flat plane that is in contact with the paper S. The heating section 21 also includes a holding member 23 and a planate heater 24 between the heating plate 22 and the holding member 23. The heating plate 22, the holding member 23 and the heater 24 constitute the heating member.

The heater 24 is a sheet heater configured with a metallic foil (SUS304) sandwiched with insulating material such as polyimide (PI), for example. The heater 24 has an excellent structural property in thinness and flexibility, is constructed with a thin-wall material. The heater 24 has a very fast rate of temperature rise during heating. The heating plate 22 is a material excellent in heat conduction, and uses aluminum alloy (A5052P-H34) for example. Incidentally, the heat source of the color erasing section 20 is not restricted to a sheet heater. For example, the heat source for the first color erasing section 201 of the upstream side of the conveying path can be configured with a halogen lamp. The heat source for the second color erasing section 202 of the downstream side of the conveying path can be configured with two halogen lamps for the main lamp, each of which have smaller heat capacity than the halogen lamp for the first color erasing section 201, and a sub lamp. Likewise, two, three or more halogen lamps can be used for heating.

The holding member 23 is covered by a cover 25. A spring 26 for pressurization is provided within the cover 25. A supporting member 27 is arranged at the top of the cover 25. The supporting member 27 is designed to hold the heater 24 in parallel with the conveying path of the paper S, and to press the heating member (including the heater 24) to a direction of the conveying path 142. The spring 26 is assembled around a shaft 28. The shaft 28 penetrates the cover 25 and the supporting member 27. The axis 28 is fixed to the supporting member 27 by a bolt and a nut 29. The supporting member 27 is fixed within the color erasing apparatus 10.

A guide plate 31 is provided at the side of the paper feeding side of the cover 25. A guide plate 32 is provided at the side of the discharging paper of the cover 25. The guide plate 31 guides feeding of the paper S with a guide plate 33. The guide plate 33 is fixed within the color erasing apparatus 10 and faces the guide plate 31. The guide plate 32 guides discharging of the paper S with a guide plate 34. The guide plate 34 is fixed within the color erasing apparatus 10 and faces the guide plate 32. The guide plates 32 and 34 are guides for feeding the paper S to the second color erasing section 202. The platen rollers 301 and 302 are rollers wound with a PFA tube on the surface, for example.

Regarding the heating section 212 of the second color erasing section 202, references numbers for components similar to the heating section 211 are labeled and description will be omitted. The heating plate 22 of the heating section 211 is referred to as a heating plate 221; the heating plate 22 of the heating section 212 is referred to as a heating plate 222.

Figure 5:
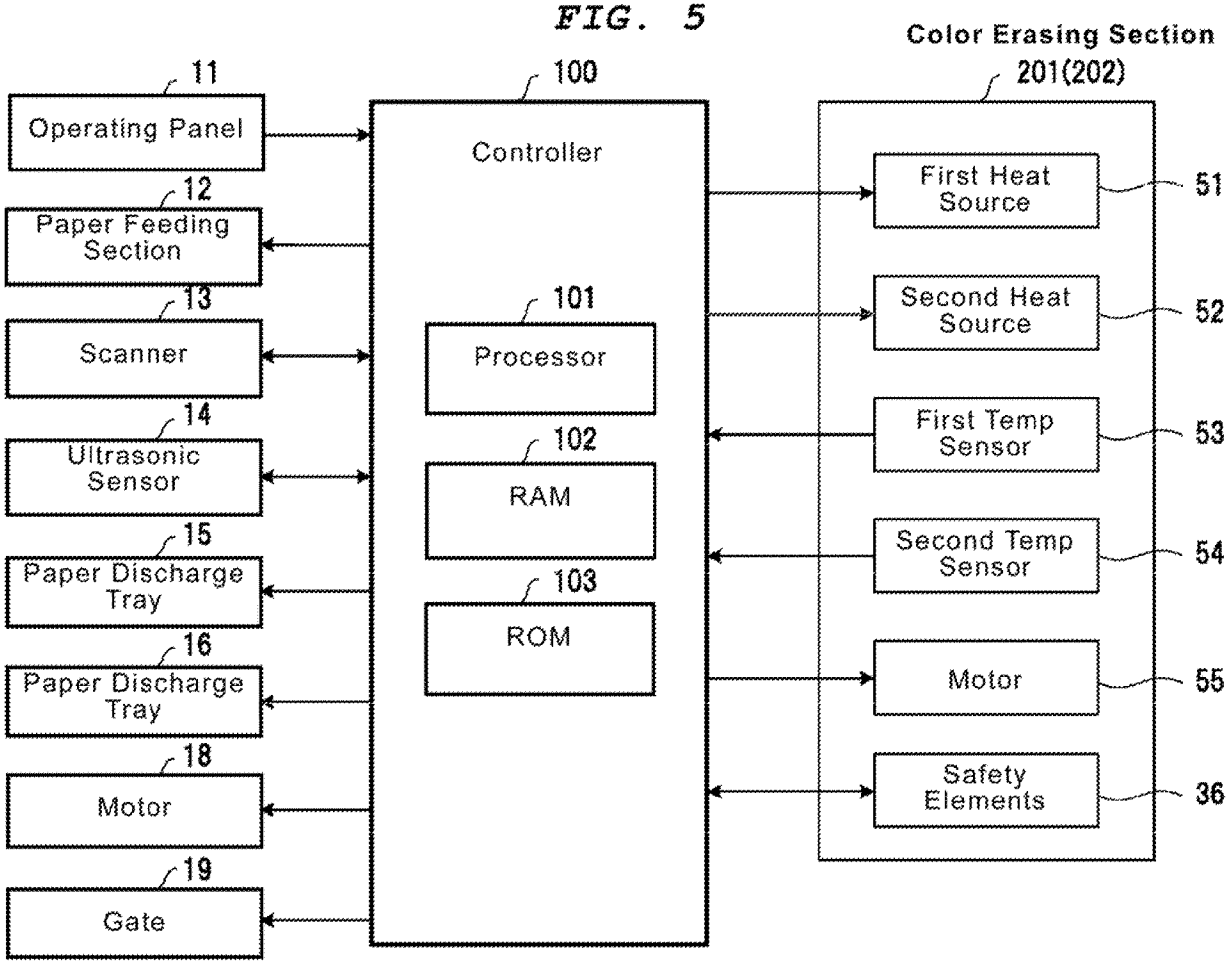
FIG. 5 illustrates a block diagram of a controller for the color erasing apparatus shown in FIG. 1.

FIG. 5 illustrates a block diagram of a controller for the color erasing apparatus. The color erasing apparatus 10 has a controller 100. The controller 100 includes a processor 101 such as a CPU, a random access memory (RAM) 102 and a read only memory (ROM) 103.

The processor 101 executes a control program stored in the ROM 103. The RAM 102 is a main memory that functions as a working memory. The ROM 103 stores the control program that operates the color erasing apparatus 10 and controlling data.

The controller 100 controls the paper feeding section 12, the scanner 13, the ultrasonic sensor 14, the paper discharge trays 15 and 16, the motor 18 and the gate 19 based on the instruction from the operating panel 11. The operating panel 11 provides a button to start erasing, for example. The paper feeding section 12 feeds papers with images into the conveying path of the color erasing apparatus 10 one by one. The scanner 13 scans images on the fed papers and stores the data.

The controller 100 controls the motor 18, drives the conveying roller 17 of the first to fifth conveying paths 141 to 145, and controls conveyance of the paper. The controller 100 also controls the gate 19 for conveying the paper to the selected conveying path. Finally, erased papers are discharged to the first paper discharge tray 15, and papers failed to be erased and papers with tearing and a wrinkle are discharged to the second paper discharge tray 16.

In addition, the controller 100 controls of a first heat source 51 and a second heat source 52. The controller 100 responds to the result from a first temperature sensor 53 and a second temperature sensor 54 and controls the first heat source 51 and the second heat source 52. The controller 100 also controls a conveying motor 55 that drives rotation of the platen roller 301 and 302.

The first heat source 51 corresponds to the heater 24 (or a heat source 241 of a heating roller 213) of the first color erasing section 201. The second heat source 52 corresponds to the heater 24 (or a heat source 242 of a heating roller 214) of the second color erasing section 202.

The first temperature sensor 53 and the second temperature sensor 54 correspond to thermistors (drawing omitted) of the first color erasing section 201 and the second color erasing section 202. The controller 100 stops energization to the heater 24 and ensures safety when overheating of the heater 24 is detected by either of safety elements 36 of the first color erasing section 201 and the second color erasing section 202.

Figure 6:
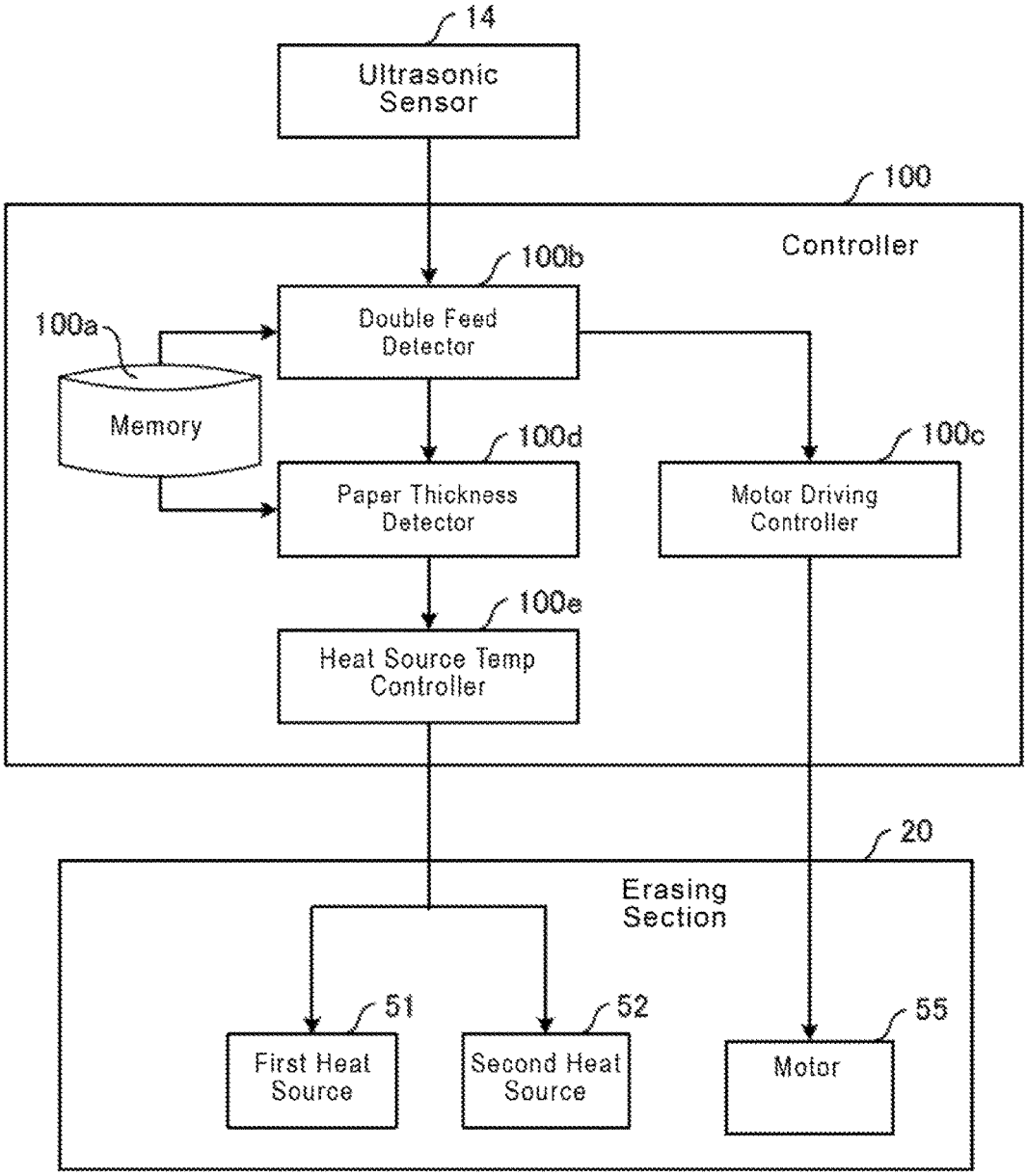
FIG. 6 illustrates a block diagram for controlling a heat source.

FIG. 6 illustrates a block diagram for controlling a heat source. The controller 100 herein includes a receiving sensitivity memory 100*a*, a double feed detector 100*b*, a motor driving controller 100*c*, a paper thickness detector 100*d*, and a heat source temperature controller 100*e*.

Figure 7:
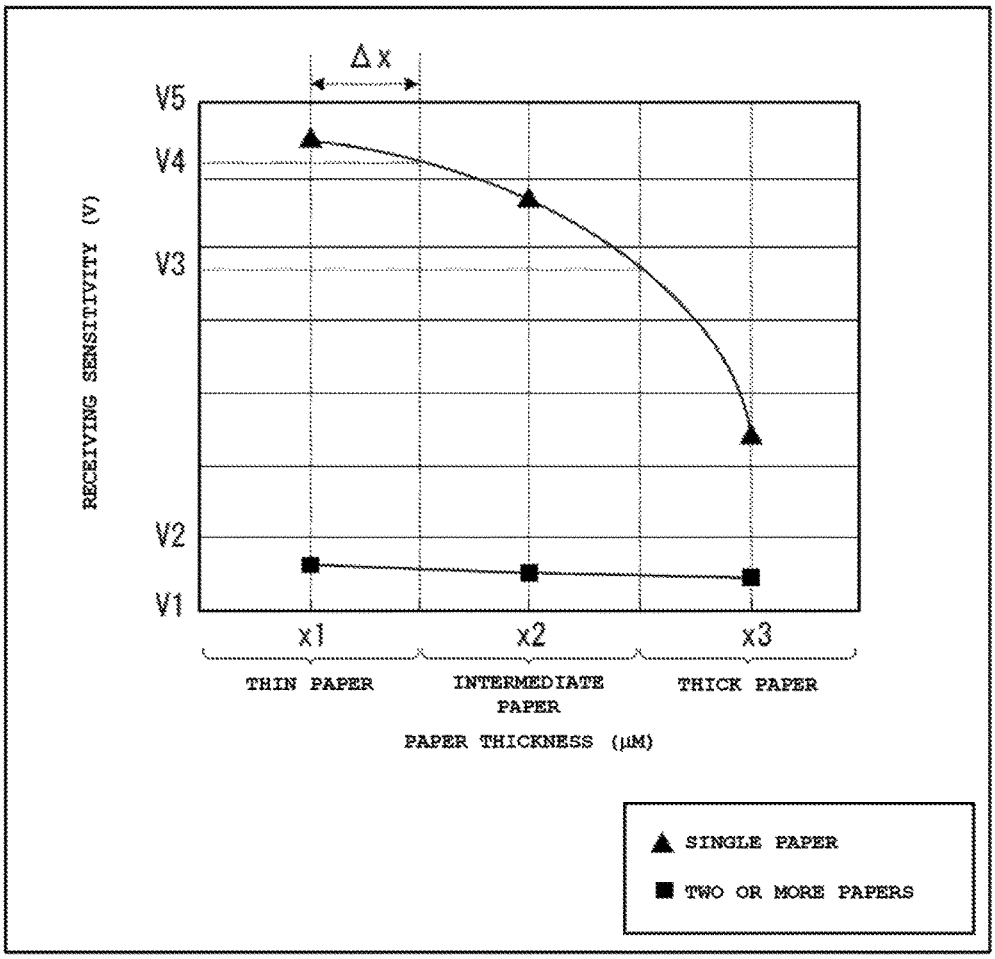
FIG. 7 illustrates data relationship of receiving sensitivity stored in a memory shown in FIG. 6.

FIG. 7 illustrates a data relationship of receiving sensitivity stored in memory. The receiving sensitivity memory 10*a* is a memory device that stores the data relationship between receiving sensitivity (voltage signal) of the ultrasound penetrated the paper and the thickness of the paper, shown in FIG. 7. In FIG. 7, the receiving sensitivity memory 100*a* sorts the thickness of the paper into at least three categories: thin (x1 [μm]), intermediate (x2 [μm]), and thick (x3 [μm]). The spectrum of receiving sensitivity corresponding to each category is predefined based on the value obtained by experiments and simulations. Relations of the thickness of the paper x1, x2 and x3 are defined as $x1<x2<x3$. In addition, as shown in FIG. 6, it is preferable for the values of x1, x2 and x3 to have a certain range Δx. Also, relations of the receiving sensitivity V1 to V5 are defined as $V1<V2<V3<V4<V5$.

Reference "▲" denotes the receiving sensitivity of a single paper, and "■" denotes the receiving sensitivity of multi-feed paper. As can be seen, when multi-feed occurs, the effect from the thickness of the paper change is insignificant, and transitions between V1 and V2 (V). In contrast, in case of a single paper, the receiving sensitivity is between V4 and V5 (V) with thin papers, between V3 and V4 (V) with intermediate papers, and smaller than V3 (V) with thick papers.

The double feed detector 100*b* is a program designed to detect multi-feed of the paper based on the voltage signal output by the ultrasonic sensor 14. In this embodiment, the double feed detector 100*b* detects multi-feed of the paper by referring to the receiving sensitivity memory 100*a*. Values are computed based on the voltage signal and multi-feed can also be detected.

The motor driving controller 100*c* is configured to control the drive of motors provided inside the color erasing apparatus 10. For instance, driving of the motor 18 is controlled to stop conveying the paper when the double feed detector 100*b* detects multi-feed of the paper.

The paper thickness detector 100*d* is configured to detect the thickness of the paper based on the voltage signal output by the ultrasonic sensor 14. In this embodiment, as similar to the double feed detector 100*b*, the paper thickness detector 100*d* detects the thickness of the paper by referring the receiving sensitivity memory 100*a*. Values are computed based on the voltage signal; multi-feed can be also detected.

The heat source temperature controller 100*e* is configured to control the heat source temperature in the color erasing section 20 based on the thickness of the paper detected by the paper thickness detector 100*d*, so long as the double feed detector 100*b* does not detect multi-feed of the paper. The heat source temperature is the heating temperature of the first heat source 51 and the second heat source 52. In order to erase images on the paper steadily, the heat source temperature is set relatively higher than the lowest temperature at which erasable coloring material that forms an image can be erased.

The heat source temperature controller 100*e* sets the heat source temperature in the color erasing section 20 higher as the thickness of the paper becomes thicker, as detected by the paper thickness detector 100*d*. Conversely, the heat source temperature controller 100*e* sets the heat source temperature in the color erasing section 20 lower as the thickness of the paper becomes thinner. In other words, the heat source temperature is moved up or down as the paper thickness is thicker or thinner.

In particular, an appropriate temperature for "thin paper" is T1 [° C.], and an appropriate temperature for "intermediate paper" is T2 [° C.], which is a predefined degree higher than the temperature T1 of the "thin paper". An appropriate temperature for "thick paper" is the temperature T3 [° C.] for predefined degree, which is further higher than the T2 of the "intermediate paper". Thus, the relation of the heat source temperature for those is T1<T2<T3.

As described above, the color erasing section 20 includes the first color erasing section 201 and the second color erasing section 202. Therefore, the heat source temperature controller 100*e* is preferably configured to control the heat source temperature for the first heat source 51 and the second heat source 52 individually, in order to efficiently erase the image. In particular, the heat source temperature controller 100*e* sets the temperature heating the paper by the second heat source 52 lower than the temperature heating the paper by the first heat source 51. When reaching to the second color erasing section 202 at downstream, the paper passed the first color erasing section 201 still retains the heat while the temperature is slightly reduced, and the paper is pre-heated. Therefore, although the power consumption of the second heat source 52 (the heater 24) in the second color erasing section 202 is reduced, the paper can be heated at a temperature necessary for efficient erasing.

Figure 8:
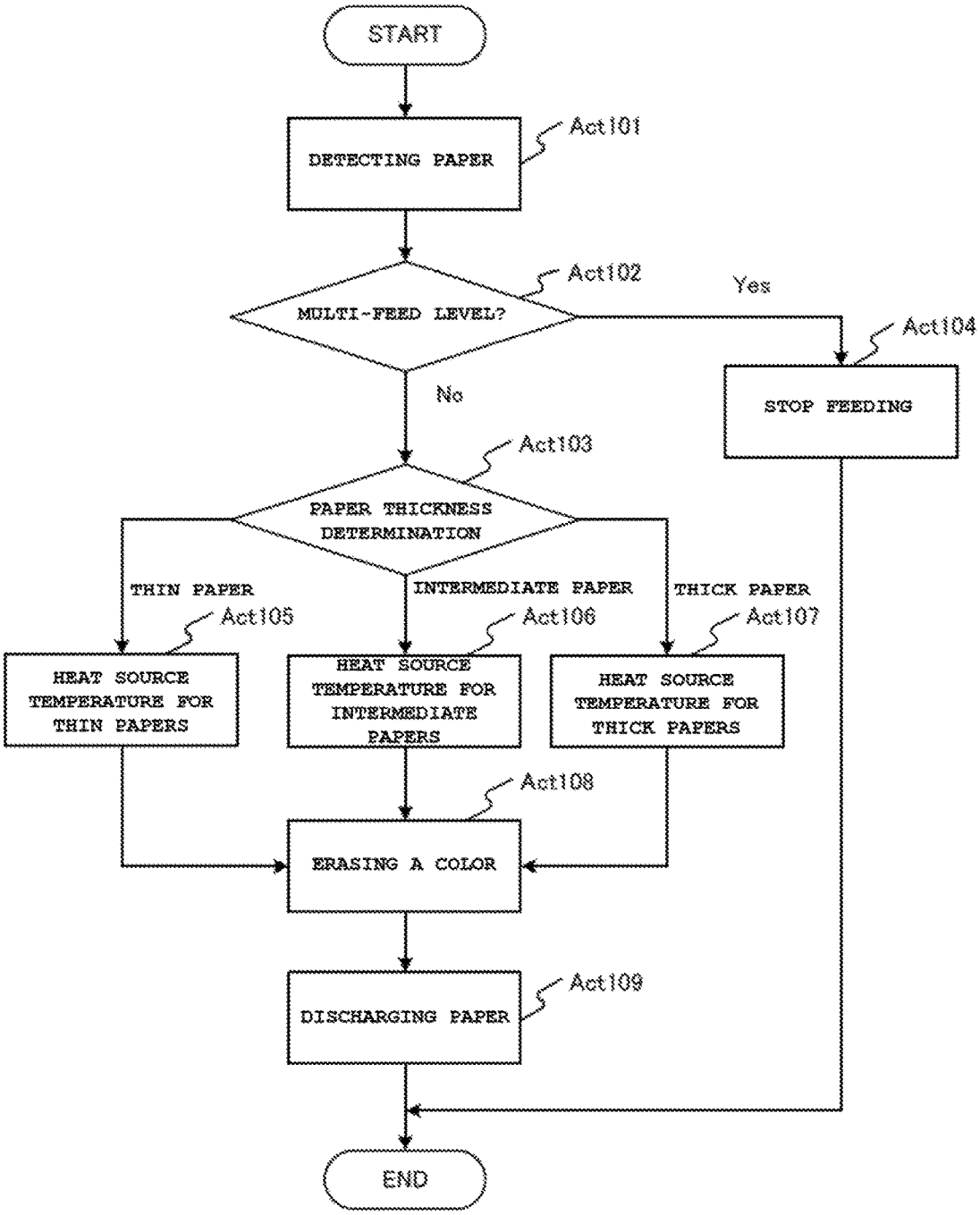
FIG. 8 illustrates a flow diagram for a process of the temperature control in the color erasing apparatus shown in FIG. 1.

FIG. 8 illustrates a flow diagram of a specific example for a process of the temperature control for heat source in the color erasing apparatus 10.

The ultrasonic sensor 14 receives an ultrasonic signal transmitted to the paper and outputs the corresponding voltage signal as to the receiving sensitivity to the controller 100 (the double feed detector 100*b*) upon detecting the paper fed from the paper feeding section 12 (Act 101).

The double feed detector 100*b* determines if the voltage signal indicates multi-feeding of the paper by referring the receiving sensitivity memory 100*a* based on the voltage signal that the ultrasonic sensor 14 output (Act 102). If the voltage signal is determined to not be at the level of multi-feeding of the paper (Act 102: No), it proceeds to Act 103. In contrast, if it is determined to be at the level of multi-feeding of the paper (Act 102: Yes), the motor driving controller 100*c* controls the drive of the motor 18 based on the determination and stops the conveyance of the paper by the conveying roller 121 (Act 104) to terminate the process.

In Act 103, the paper thickness detector 100*d* refers to the receiving sensitivity memory section and, based on the voltage signal output by the ultrasonic sensor 14, detects the thickness of the paper, and outputs the detected paper thickness to the heat source temperature controller 100*e*.

If the paper thickness detector 100*d* determines that the thickness of the paper is at the level of "thin paper", the heat source temperature controller 100*e* controls the heat source temperature of the heat source of the color erasing section 20 (the first heat source 51 and the second heat source 52) to the temperature T1 [° C.] that is appropriate for "thin paper" (Act 105). Processing then proceeds to Act 108.

If the paper thickness detector 100*d* determines that the thickness of the paper is at the level of "intermediate paper", the heat source temperature controller 100*e* controls the heat source temperature of the heat source of the color erasing section 20 (the first heat source 51 and the second heat source 52) to the temperature T2 [° C.] that is a certain degree higher than the temperature for "thin paper" (T2>T1) and appropriate for "intermediate paper" (Act 106). Processing then proceeds to Act 108.

Similarly, If the paper thickness detector 100*d* determines that the thickness of the paper is at the level of "thick paper", the heat source temperature controller 100*e* controls the heat source temperature of the heat source of the color erasing section 20 (the first heat source 51 and the second heat source 52) to the temperature T3 [° C.] that is a certain degree higher than the temperature for "intermediate paper" (T3>T2) and appropriate for "thick paper" (Act 107). Processing then proceeds to Act 108.

In Act 108, the color erasing section 20 conveys the paper in the conveying path while heating the paper by the heat source of the color erasing section 20 (the first heat source 51 and the second heat source 52) that is temperature controlled by the heat source temperature controller 100*e*, and erases images formed on the paper.

The motor driving controller 100*c* controls a plurality of motors driving the conveying roller 17 and the gate 19, conveys the paper erased by the color erasing section 20 to the first paper discharge tray 15 in order to reuse (Act 109). The processing then ends.

According to the color erasing apparatus 10, which relates to the present embodiment, temperature control of the heat source can be conducted depending to the variable heat capacity of the paper according to the paper thickness, when erasing images on the paper by heating the paper with the color erasing section 20. Consequently, the power consumption of the color erasing apparatus can be suppressed. Also, cost for manufacturing can be suppressed, because the apparatus configuration allows the ultrasonic sensor 14 to detect the thickness of the paper, and the ultrasonic sensor is conventionally incorporated in order to detect multi-feeding of the paper.

In the embodiment described above, the configuration is designed to suppress power consumption by controlling the heat source temperature higher as the paper becomes thicker and lower as the paper thinner.

Figure 9:
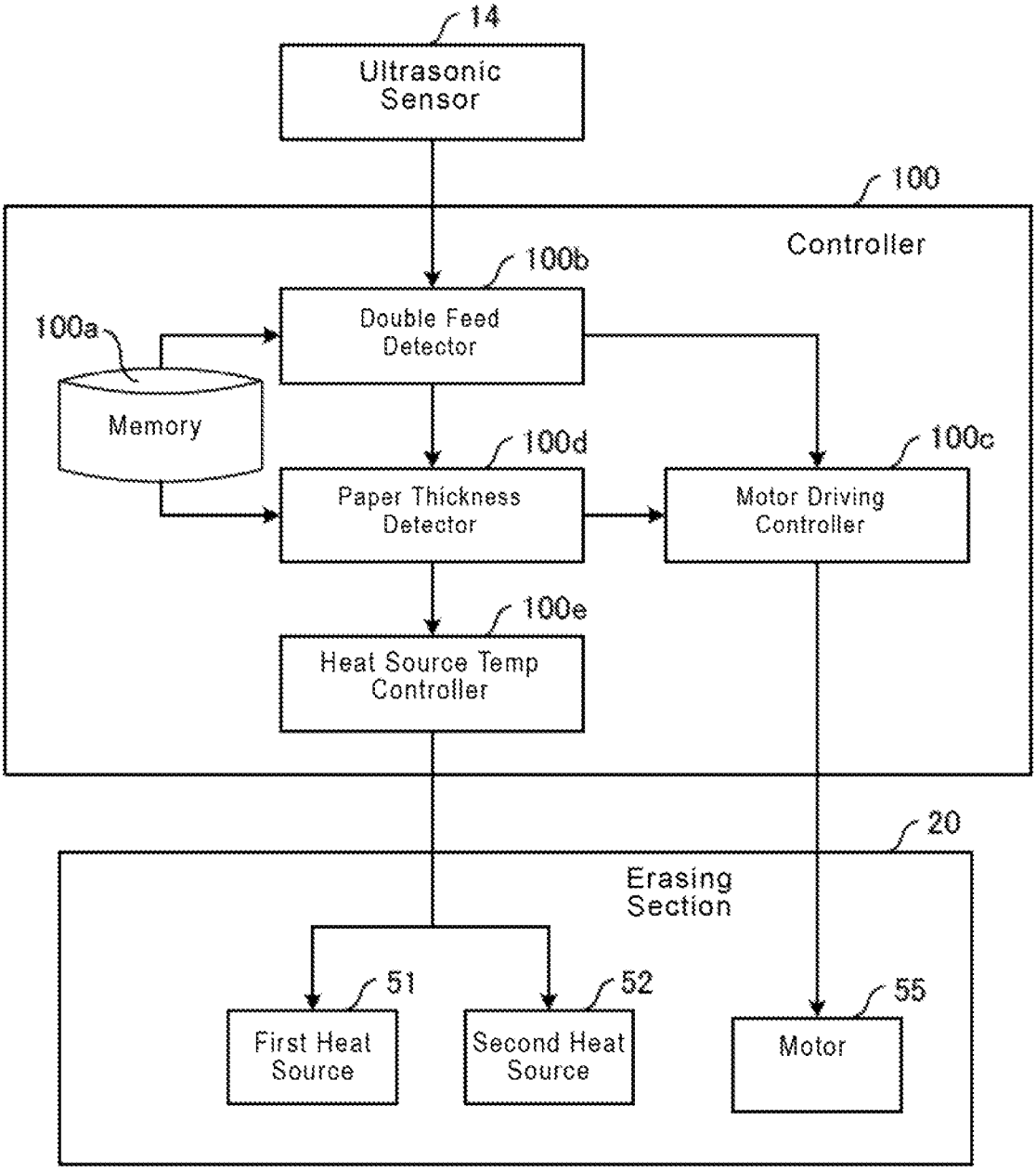
FIG. 9 illustrates a block diagram of a heat source controller shown in FIG. 6, according to an alternative embodiment.

FIG. 9 illustrates a block diagram of a function relates to temperature control for the heat source in an alternative example of the controller 100. Herein, the motor driving controller 100*c* controls the drive speed of the conveying motor 55, and thus controls the conveying speed of the paper passing through the color erasing section 20, based on the information of the thickness of the paper detected by the paper thickness detector 100*d*. In particular, the conveying speed of the paper passing through the color erasing section 20 is made slower as the thickness of the paper detected by the paper thickness detector 100*d* becomes thicker. Similarly, the conveying speed of the paper passing through the color erasing section 20 is made faster as the thickness of the paper becomes thinner. The conveying speed of the paper is conversely controlled to be increased or decreased based on an increase or decrease of the thickness of the paper. Thicker papers have larger heat capacity, requiring a longer period of time to reach the temperature high enough for erasing the erasable coloring material on the paper. In contrast, thinner papers have smaller heat capacity, and therefore need only shorter period of time to reach the temperature for erasing the erasable coloring material on the paper. The control by the motor driving controller 100*c* can be conducted based on paper thickness together with the control of the heat source temperature by the heat source temperature controller 100*e* as explained above. The motor driving controller 100*c* can be also be controlled based on paper thickness by itself.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A color erasing apparatus comprising:

a color erasing unit, including a heating unit, configured to heat a paper to erase an image formed on the paper by a heat-erasable coloring material;

a sensor configured to output a sensor signal indicative of a thickness of the paper;

a paper thickness detector configured to determine the thickness of the paper based on the sensor signal; and a heating unit controller configured to control temperature of the heating unit based on the thickness of the paper determined by the paper thickness detector, wherein when the thickness of the paper determined by the paper thickness detector is greater than a first predetermined thickness, the temperature is controlled to be a first temperature, when the thickness of the paper determined by the paper thickness detector is less than the first predetermined thickness, the temperature is controlled to be a second temperature less than the first temperature, and when the thickness of the paper determined by the paper thickness detector is less than a second predetermined thickness smaller than the first predetermined thickness, the temperature is controlled to be a third temperature less than the second temperature.

2. The color erasing apparatus according to claim 1, wherein the sensor comprises an ultrasonic transmitter and an ultrasonic receiver facing each other across a conveying path through which the paper is conveyed, the ultrasonic transmitter configured to transmit an ultrasonic signal to the paper, and the sensor configured to output the sensor signal based on the ultrasonic signal that has penetrated the paper and is received by the ultrasonic receiver.

3. The color erasing apparatus according to claim 2, wherein the sensor signal is also indicative of a multi-feed of the paper, the color erasing apparatus further comprising:

a double-feed detector that detects multi-feeding of the paper based on the sensor signal.

4. The color erasing apparatus according to claim 3, further comprising a controller configured to stop conveying the paper if a multi-feed is detected by the double-feed detector.

5. The color erasing apparatus according to claim 3, further comprising:

a memory section configured to store a predefined relation between the ultrasonic signal received by the ultrasonic receiver and the thickness of the paper, wherein the double-feed detector and the paper thickness detector determine the multi-feed of the paper and the thickness of the paper, respectively, based on the sensor signal compared to the predefined relation.

6. The color erasing apparatus according to claim 1, further comprising:

a conveying unit configured to convey the paper through the color erasing unit; and a conveying unit controller configured to control a conveyance speed of the paper conveyed through the color erasing unit based on the thickness of the paper determined by the paper thickness detector.

7. The color erasing apparatus according to claim 6, wherein:

the conveying unit controller is further configured to when the thickness of the paper determined by the paper thickness detector is greater than the first predetermined thickness, control the conveyance speed to be a first speed, and when the thickness of the paper determined by the paper thickness detector is less than the second predetermined thickness, control the conveyance speed to be a second speed greater than the first speed.

8. The paper heating apparatus according to claim 1, further comprising:

a conveying unit controller configured to control a conveyance speed of the paper conveyed through the color erasing unit based on the thickness of the paper determined by the paper thickness detector.

9. A method for erasing images comprising:

conveying a paper on a conveying path, the paper having an image formed by heat-erasable coloring material;

providing a sensor signal indicative of a thickness of the paper being conveyed on the conveying path;

detecting thickness of the paper based on the sensor signal;

conveying the paper through a color erasing unit including a heating unit configured to heat the paper to erase the image; and controlling a temperature of the heating unit based on the detected thickness of the paper, wherein when the detected thickness of the paper is greater than a first predetermined thickness, the temperature is controlled to be a first temperature, when the detected thickness of the paper is less than the first predetermined thickness, the temperature is controlled to be a second temperature less than the first speed, and when the detected thickness of the paper is less than a second predetermined thickness smaller than the first predetermined thickness, the temperature is controlled to be a third temperature less than the second temperature.

10. The method for erasing images according to claim 9, wherein the sensor signal is generated by a sensor comprising an ultrasonic transmitter and an ultrasonic receiver facing each other having the conveying path in the middle, the ultrasonic transmitter configured to transmit an ultrasonic signal to the paper, and the sensor configured to output the sensor signal based on the ultrasonic signal that has penetrated the paper and is received by the ultrasonic receiver.

11. The method for erasing images according to claim 10, wherein the sensor signal is also indicative of a multi-feed of the paper, the method further comprising:

detecting a multi-feeding of the paper based on the sensor signal.

12. The method for erasing images according to claim 11, further comprising stopping conveying the paper if a multi-feed is detected by the double-feed detector.

13. The method for erasing images according to claim 11, further comprising:

storing a predefined relation between the ultrasonic signal received by the ultrasonic receiver and the thickness of the paper, wherein detecting a multi-feeding of the paper and determining the thickness of the paper are based on the sensor signal compared to the predefined relation.

14. A paper heating apparatus comprising:

a heating unit configured to heat a paper;

a sensor configured to output a sensor signal indicative of a thickness of the paper;

a paper thickness detector configured to determine the thickness of the paper based on the sensor signal;

a conveying unit configured to convey the paper through the heating unit; and a heating unit controller configured to control a temperature of the paper conveyed through the heating unit based on the thickness of the paper determined by the paper thickness detector, wherein when the thickness of the paper determined by the paper thickness detector is greater than a first predetermined thickness, the conveyance temperature is controlled to be a first temperature, when the thickness of the paper determined by the paper thickness detector is less than the first predetermined thickness, the temperature is controlled to be a second temperature less than the first temperature, and when the thickness of the paper determined by the paper thickness is less than a second predetermined thickness smaller than the first predetermined thickness, the temperature is controlled to be a third temperature less than the second temperature.

15. The paper heating apparatus according to claim 14, wherein the sensor comprises an ultrasonic transmitter and an ultrasonic receiver facing each other across a conveying path through which the paper is conveyed, the ultrasonic transmitter configured to transmit an ultrasonic signal to the paper, and the sensor configured to output the sensor signal based on the ultrasonic signal that has penetrated the paper and is received by the ultrasonic receiver.

16. The paper heating apparatus according to claim 15, wherein the sensor signal is also indicative of a multi-feed of the paper, the paper heating apparatus further comprising:

a double-feed detector that detects multi-feeding of the paper based on the sensor signal, and the conveying unit controller stops the conveying unit from conveying the paper through the heating unit if a multi-feed is detected by the double-feed detector.

17. The paper heating apparatus according to claim 15, further comprising:

a memory section configured to store a predefined relation between the ultrasonic signal received by the ultrasonic receiver and the thickness of the paper, wherein the double-feed detector and the paper thickness detector determine the multi-feed of the paper and the thickness of the paper, respectively, based on the sensor signal compared to the predefined relation.

* * * * *